US010907571B2

(12) United States Patent
Yang et al.

(10) Patent No.: US 10,907,571 B2
(45) Date of Patent: Feb. 2, 2021

(54) STRUCTURE MOUNTED IN WATER JACKET FOR CYLINDER BLOCK

(71) Applicants: Kia Motors Corporation, Seoul (KR); Hyundai Motor Company, Seoul (KR)

(72) Inventors: Il Suk Yang, Hwaseong-si (KR); Soo Hyung Woo, Yongin-si (KR); Jaewook Kang, Hwaseong-si (KR); Sung-Chan Cho, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/552,663

(22) Filed: Aug. 27, 2019

(65) Prior Publication Data

US 2020/0182189 A1 Jun. 11, 2020

(30) Foreign Application Priority Data

Dec. 6, 2018 (KR) ..... 10-2018-0156017

(51) Int. Cl.

| | |
|---|---|
| ***F02F 1/14*** | (2006.01) |
| ***F01P 3/02*** | (2006.01) |
| ***F02F 1/36*** | (2006.01) |

(52) U.S. Cl.

CPC ..... *F02F 1/14* (2013.01); *F01P 3/02* (2013.01); *F02F 1/36* (2013.01); *F01P 2003/021* (2013.01)

(58) Field of Classification Search

CPC ..... F02F 1/14; F02F 1/10; F02F 2001/104; F01P 2003/021; F01P 7/14; F01P 2003/027

See application file for complete search history.

(56) References Cited

U.S. PATENT DOCUMENTS

| | | | | |
|---|---|---|---|---|
| 2017/0022929 | A1* | 1/2017 | Karita | F02F 1/166 |
| 2017/0045012 | A1* | 2/2017 | Okawa | F02F 1/16 |
| 2017/0067411 | A1* | 3/2017 | Doho | F01P 3/02 |
| 2018/0094568 | A1* | 4/2018 | Yanagi | F01P 3/02 |
| 2018/0328277 | A1* | 11/2018 | Yoshimura | F02B 77/11 |
| 2018/0355780 | A1* | 12/2018 | Fujita | F01P 3/02 |
| 2018/0363587 | A1* | 12/2018 | Yoshimura | F02F 1/14 |
| 2019/0032595 | A1* | 1/2019 | Yoshimura | F01P 3/02 |
| 2019/0360427 | A1* | 11/2019 | Fujita | F02F 1/14 |

* cited by examiner

*Primary Examiner* — Long T Tran
(74) *Attorney, Agent, or Firm* — Slater Matsil, LLP

(57) ABSTRACT

A structure is mounted in a water jacket for a cylinder block of an engine so as to surround a block bore. The structure includes a body forming a pad mounting portion being a panel formed in an arc shape to have inner and outer curved surfaces that are surrounded by the block bore. A mounting hole is extended through the inner and outer curved surfaces of the pad mounting portion. A pad is formed in a shape to correspond with the mounting hole. The pad has a curved surface and is inserted into the mounting hole in a water tight manner.

20 Claims, 6 Drawing Sheets

STRUCTURE MOUNTED IN WATER JACKET FOR CYLINDER BLOCK

CROSS-REFERENCE TO RELATED APPLICATIONS

This application claims priority to Korean Patent Application No. 10-2018-0156017, filed in the Korean Intellectual Property Office on Dec. 6, 2018, which application is hereby incorporated herein by reference.

TECHNICAL FIELD

The present invention relate to a structure mounted in a water jacket for a cylinder block.

BACKGROUND

Generally, heat generated from a combustion chamber of an engine is absorbed to a cylinder head, a cylinder block, an intake/exhaust valve, a piston, and so on, a water jacket through which coolant is flowed for cooling an engine is formed at a cylinder block and a cylinder head so as to often circulate coolant in a up and down direction of an engine.

If heat is absorbed to the constituent components of the engine, thereby excessively increasing temperature thereof, heat strain thereof may be occurred or lubrication fail may be generated as oil film coated an interior surface of the cylinder is removed. Thus, fault of the engine may be occurred, and fault of the engine is cause of abnormal combustion such as miss ignition, knocking, or pre-ignition. The abnormal combustion may damage the piston, and as a result, there is a problem that thermal efficiency and output of the engine may be deteriorated. On the other hand, there are problems that output and fuel consumption of the engine may be deteriorated and low temperature abrasion of the cylinder may be occurred by excessively cooling the engine. Therefore, it is required that cooling of the engine by coolant is properly controlled.

However, if configuration of a water jacket is to be complex by considering each cooling performance being applying to respectively parts when a cooling type of circulating coolant through the water jacket is used, productivity may be deteriorated as a process for manufacturing the water jacket is to be convoluted. Meanwhile, if a water jacket having simple configuration is applied for improving productivity, cooling performance may be deteriorated or unnecessary cooling may be excessively performed to any part according to difference between each cross-section of respectively parts.

The above information disclosed in this Background section is only for enhancement of understanding of the background of the invention and therefore it may contain information that does not form the prior art that is already known in this country to a person of ordinary skill in the art.

SUMMARY

The present invention relate to a structure mounted in a water jacket for a cylinder block. Particular embodiments relate to a structure mounted in a water jacket for a cylinder block for efficiently cooling an engine.

Embodiments of the present invention can provide a structure mounted in a water jacket for a cylinder block having advantages of preventing unnecessary cooling by a water jacket for a cylinder block, and simultaneously, improving an overall cooling performance to required parts.

A structure mounted in a water jacket for a cylinder block according to an exemplary embodiment of the present invention may be a structure that is arranged in a water jacket formed to surround a block bore at a cylinder block of an engine.

The structure mounted in a water jacket for a cylinder block according to an exemplary embodiment of the present invention may include a body forming a pad mounting portion which is a panel formed in an arc shape to have curve surfaces as both surfaces so as to surround the block bore. A pad is formed in a shape to correspond with a mounting hole which is bored to the pad mounting portion through both surfaces respectively having a curve surface and inserted into a mounting hole such that water tightness is ensured.

The body may be disposed at a part in an up and down direction of the water jacket.

The body may be formed of a plastic material.

The body may be formed in a plate shape that at least two pad mounting portions are arranged, and the pad may be mounted to each pad mounting portion.

The pad may be formed of a hydrophilic expansion rubber material.

The pad mounting portion may include a mounted upper end closing an upper side of the mounting hole. A mounted lower and is disposed to face to the mounted upper end and is adapted to close a lower side of the mounting hole. A mounted one and connects the mounted upper end with the mounted lower end and closing one side of the mounting hole. A mounted other and is disposed to face to the mounted one end and adapted to connect the mounted upper end with the mounted lower end and close the other side of the mounting hole.

The pad may include a pad upper end coupled to the mounted upper end so as to ensure water tightness, a pad lower end coupled to the mounted lower end so as to ensure water tightness, a pad one end coupled to the mounted one end so as to ensure water tightness, and a pad other end coupled to the mounted other end so as to ensure water tightness.

The pad mounting portion may further include a coupling protrusion protruded along the mounted upper end, the mounted one end, the mounted lower end, and the mounted other end.

The pad may further include a coupling groove recessed in a shape to correspond with the coupling protrusion along the pad upper end, the pad one end, the pad lower end, and the pad other end such that the coupling protrusion is sat thereon.

The coupling protrusion may be formed so as to be continuously protruded to cross the mounted upper end, the mounted one end, the mounted lower end, and the mounted other end.

The pad mounting portion may further include a stiffening rib formed in a bar shape to connect the coupling protrusion which is formed at the mounted one end with the coupling protrusion which is formed at the mounted other end so as to partition the mounting hole into two sections.

The pad may further include a rib hole bored into the pad from the coupling groove which is formed at the pad one end to the coupling groove which is formed at the pad other end and formed in a shape to correspond with the stiffening rib such that the stiffening rib is sat thereon.

The mounting hole may be halved by the stiffening rib.

The stiffening rib may have a curvature to be equal to the pad mounting portion.

The coupling groove may be formed to be continuously recessed to cross the pad upper end, the pad one end, the pad lower end, and the pad other end.

The pad may be directly injection-molded to the body.

Thicknesses of the mounted upper end, the mounted lower end, the mounted one end, and the mounted other end may be equal, and a thickness of the pad may be formed to be uniform and to be equal to thicknesses of the mounted upper end, the mounted lower end, the mounted one end, and the mounted other end when the pad is injection-molded.

Thicknesses of the mounted upper end, the mounted lower end, the mounted one end, and the mounted other end may be thicker than the other part of the pad mounting portion.

The mounted upper end, the mounted lower end, and the pad may have a curvature to be equal to the pad mounting portion.

When coolant is flowed in the water jacket, the pad contacting coolant may be expended in a thickness direction so as to contact to the cylinder block in a state that it is limited by respective the mounted upper end, the mounted lower end, the mounted one end, and the mounted other end that the pad upper end, the pad lower end, the pad one end, and the pad other end are respectively expanded.

DETAILED DESCRIPTION OF ILLUSTRATIVE EMBODIMENTS

An exemplary embodiment of the present invention will hereinafter be described in detail with reference to the accompanying drawings.

Figure 1:
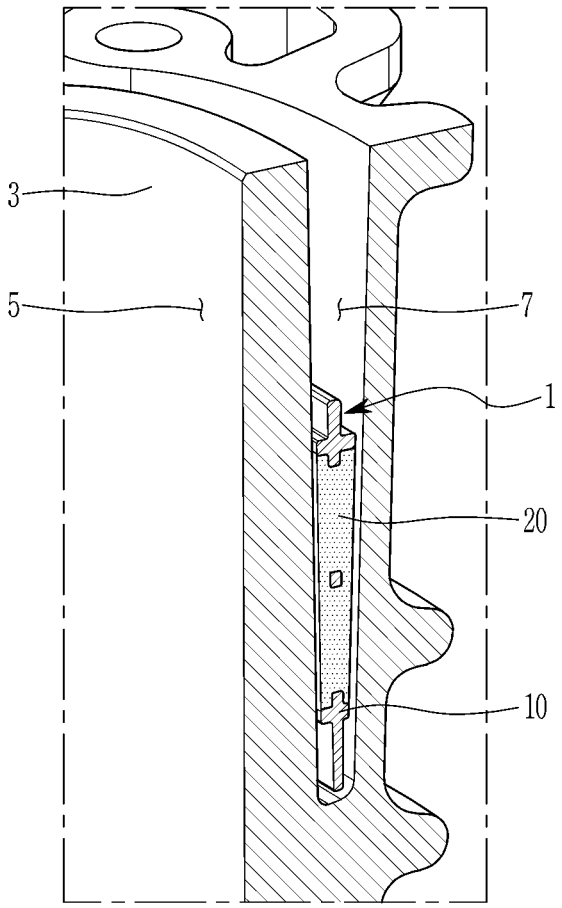
FIG. 1 is a perspective view showing a partial cross section of a cylinder block in which a structure mounted in a water jacket for a cylinder block according to an exemplary embodiment of the present invention is mounted.

FIG. 1 is a perspective view showing a partial cross section of a cylinder block in which a structure mounted in a water jacket for a cylinder block according to an exemplary embodiment of the present invention is mounted.

As shown in FIG. 1, a structure 1 mounted in a water jacket for a cylinder block according to an exemplary embodiment of the present invention is inserted into a water jacket 7 of a cylinder block 3.

The cylinder block 3 is a portion acting as a center of an engine and is coupled with a lower side of a cylinder head (not shown). In addition, at the cylinder block 3, at least one block bore 5, that is, an ordinary cylinder is formed and a piston is disposed to make a reciprocal motion in the block bore 5. The engine, which is configured by coupling the cylinder head with the cylinder block 3, is well known to a person of an ordinary skill in the art, so a detailed description thereof will be omitted.

The water jacket 7 is an empty space which is formed by arranging a core in a mold when casting the cylinder block 3 and the cylinder head, and is a coolant passage which is disposed around the block bore 5 including a combustion chamber which is formed at the cylinder head. That is, the water jacket 7 is formed at the cylinder block 3, and the water jacket 7 formed at the cylinder block 3 may be disposed to surround a circumference of the block bore 5 which is formed as a cylindrical hollow at the cylinder block 3. Configuration and function of the water jacket 7 are well known to a person of an ordinary skill in the art, so detailed descriptions thereof will be omitted.

At the cylinder block 3, in case that an upward direction is defined as a direction of coupling the cylinder head thereto and a downward direction is defined as a direction of spacing apart from the cylinder head, that is, a direction of arranging a crank case (not shown) and so on, a height of the embed structure 1 is shorter than a height of the water jacket 7. In other words, the embed structure 1 is disposed at a part in an up and down direction of the water jacket 7 in case that a reciprocal motion of the piston which moves in the block bore 5 is defined as an up and down reciprocal motion.

Figure 2:
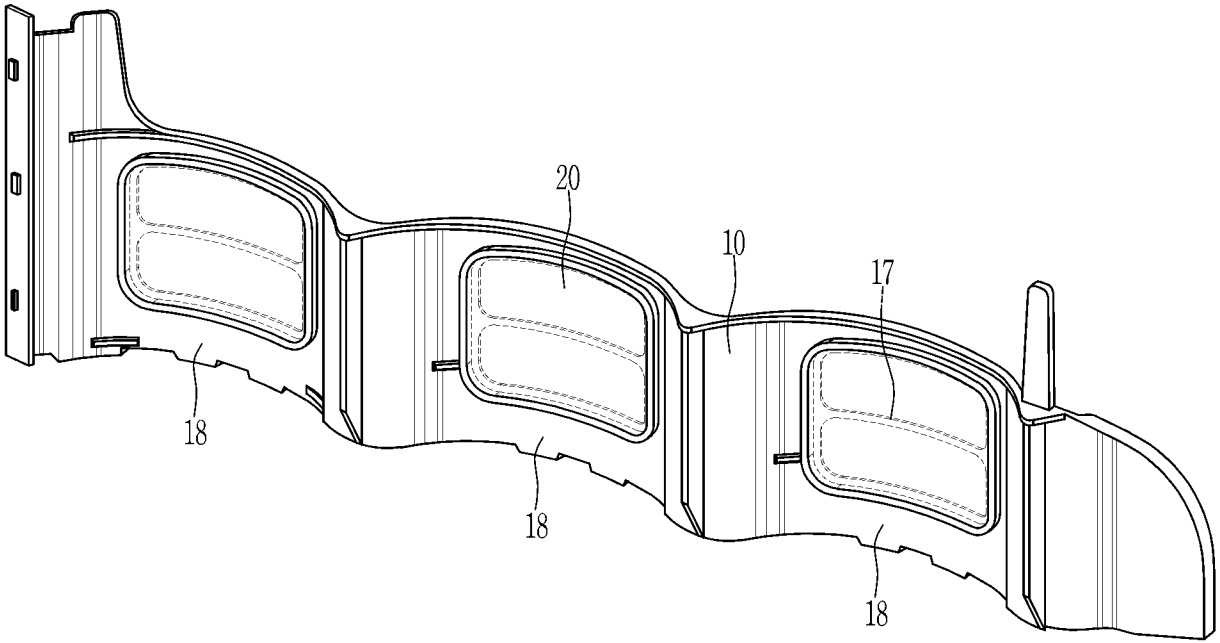
FIG. 2 is a perspective view of a structure mounted in a water jacket for a cylinder block according to an exemplary embodiment of the present invention.
Figure 3:
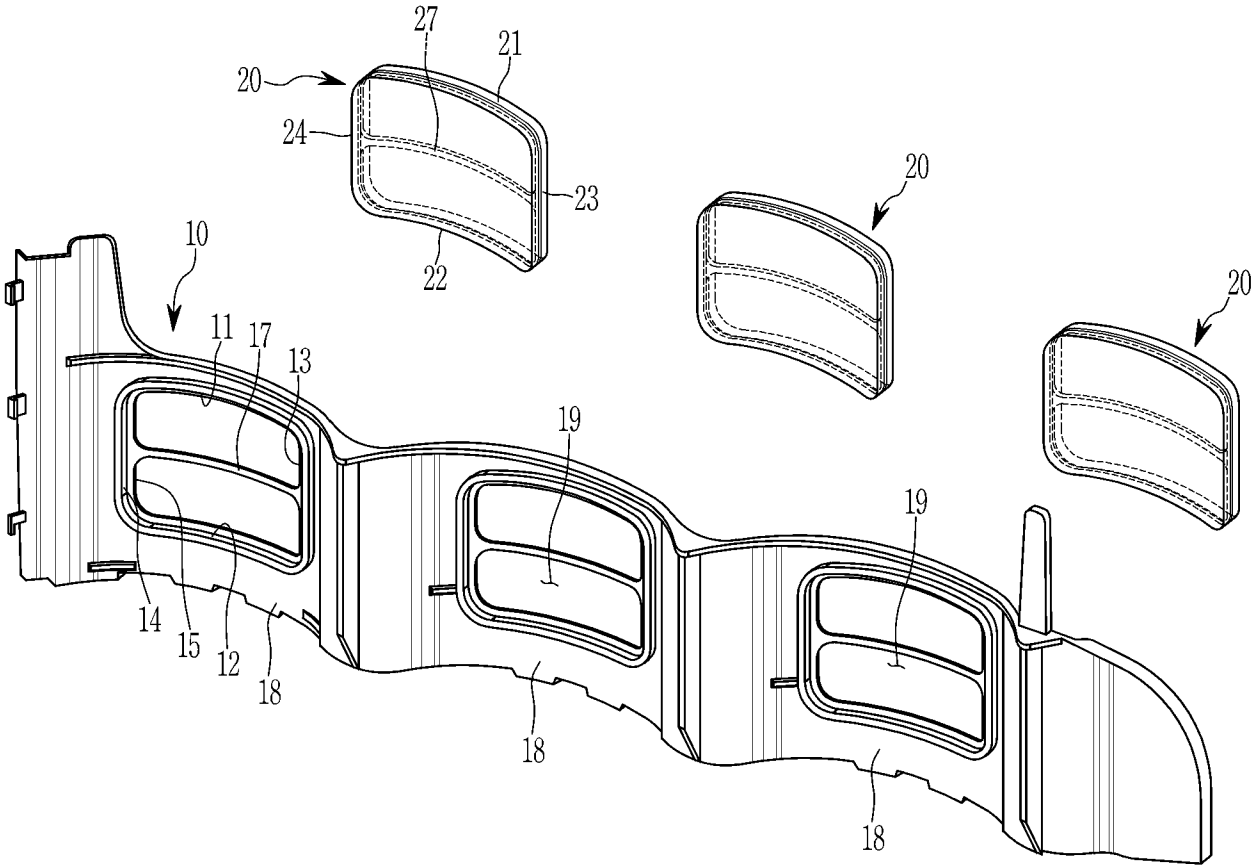
FIG. 3 is an exploded view of a structure mounted in a water jacket for a cylinder block according to an exemplary embodiment of the present invention.

FIG. 2 is a perspective view of a structure mounted in a water jacket for a cylinder block according to an exemplary embodiment of the present invention, and FIG. 3 is an exploded view of a structure mounted in a water jacket for a cylinder block according to an exemplary embodiment of the present invention.

As shown in FIGS. 1 to 3, the embed structure 1 includes a body 10 and a pad 20.

Meanwhile, it is well known to a person of an ordinary skill in the art that the block bores 5 are arranged to form at least one line in multi-cylinder engines and are arranged to form at least two lines in multi-cylinder engines such as a V-type engine.

The body 10 is formed in a plate shape that at least two panels, which are formed in an arc shape to have curve surfaces as both surfaces, are arranged and is disposed so that arc shapes of the body 10 are arranged in a direction of arranging the block bores 5. In addition, the body 10 is provided at least one such that one arc shape of the body 10 surrounds one among the block bores 5 to each one line of the block bore 5, and a pair of the bodies 10 may be provided such that a pair of arc shapes surround both sides of one among the block bores 5. Further, arc shapes may be formed to be same to or less than a number of the block bore 5 at one among the bodies 10 in one line of the block bore 5, but it may be desirable that arc shapes are formed to be same to a number of the block bore 5. Herein, an arc shape portion of the body 10 will be called "pad mounting portion 18". Meanwhile, the body 10 may be formed of a plastic material.

The pad 20 is mounted to each pad mounting portion 18. In addition, a mounting hole 19 having a shape to correspond with the pad 20 is bored through both surfaces respectively formed in a curve surface at the pad mounting portion 18, and the pad 20 is inserted into the mounting hole 19 such that water tightness is ensured between the pad 20 and the pad mounting portion 18. Meanwhile, the pad 20 may be formed of a rubber material and may be a hydrophilic expansion rubber. Herein, a hydrophilic expansion rubber, which is expanded in case of contacting water, is well known to a person of an ordinary skill in the art, so detailed descriptions thereof will be omitted.

Figure 4:
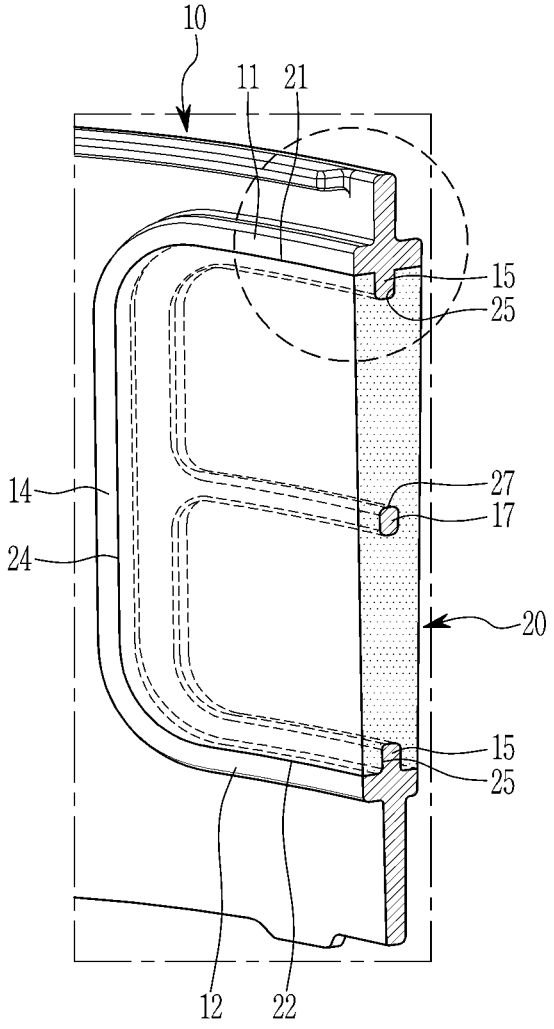
FIG. 4 is a perspective view showing a partial cross section of a structure mounted in a water jacket for a cylinder block according to an exemplary embodiment of the present invention.
Figure 5:
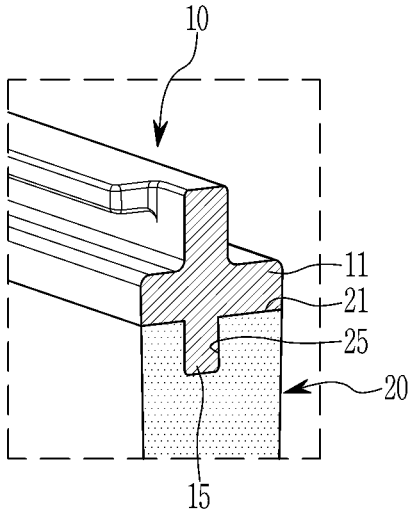
FIG. 5 is a partial enlarged view of FIG. 4.

FIG. 4 is a perspective view showing a partial cross section of a structure mounted in a water jacket for a cylinder block according to an exemplary embodiment of the present invention, and FIG. 5 is a partial enlarged view of FIG. 4.

As shown in FIGS. 3 to 5, the pad mounting portion 18 includes a mounted upper end 11, a mounted lower end 12, a mounted one end 13, a mounted other end 14, a coupling protrusion 15, and a stiffening rib 17, and the pad 20 includes a pad upper end 21, a pad lower end 22, a pad one end 23, a pad other end 24, a coupling groove 25, and a rib hole 27.

The mounted upper end 11 is a portion closing an upper side of the mounting hole 19. Herein, directions of deciding an upper side, a lower side, and both sides of the mounting hole 19 have the same reference with an up and down direction of the water jacket 7.

The mounted lower end 12 is a portion closing a lower side of the mounting hole 19. That is, the mounted lower end 12 faces to the mounted upper end 11 such the mounting hole 19 is positioned between the mounted lower end 12 and the mounted upper end 11.

The mounted one end 13 is a portion connecting the mounted upper end 11 with the mounted lower end 12 and closing one side of the mounting hole 19.

The mounted other end 14 is a portion connecting the mounted upper end 11 with the mounted lower end 12 and closing the other side of the mounting hole 19. That is, the mounted other end 14 faces to the mounted one end 13 such that the mounting hole 19 is positioned between the mounted other end 14 and the mounted one end 13.

The coupling protrusion 15 is formed along the mounted upper end 11, the mounted one end 13, the mounted lower end 12, and the mounted other end 14, and is protruded from the mounted upper end 11, the mounted one end 13, the mounted lower end 12, and the mounted other end 14 toward the mounting hole 19. In other ward, the coupling protrusion 15 is continuously protruded to cross the mounted upper end 11, the mounted one end 13, the mounted lower end 12, and the mounted other end 14 and to surround the mounting hole 19.

The stiffening rib 17 is formed in a bar shape to connect the coupling protrusion 15 formed at the mounted one end 13 with the coupling protrusion 15 formed at the mounted other end 14. In addition, the stiffening rib 17 partitions the mounting hole 19 into two sections. Meanwhile, it is desirable that the mounting hole 19 is halved by the stiffening rib 17, but not limited thereto. Further, the stiffening rib 17 functions so as to reinforce rigidity of the pad mounting portion 18 to which the mounting hole 19 is bored and to increase coherence between the pad mounting portion 18 and the pad 20. Furthermore, the stiffening rib 17 has a curvature to be equal to the pad mounting portion 18 and connects the coupling protrusion 15 formed at the mounted one end 13 with the coupling protrusion 15 formed at the mounted other end 14.

The pad upper end 21 is an upper end of the pad 20 which is coupled to the mounted upper end 11 so as to ensure water tightness. Herein, directions of deciding an upper end, a lower end, and both ends of the pad 20 have the same reference with an up and down direction of the water jacket 7.

The pad lower end 22 is a lower end of the pad 20 which is coupled to the mounted lower end 12 so as to ensure water tightness.

The pad one end 23 is one side end of the pad 20 which is coupled to the mounted one end 13 so as to ensure water tightness.

The pad other end 24 is the other side end of the pad 20 which is coupled to the mounted other end 14 so as to ensure water tightness.

The coupling groove 25 is formed along the pad upper end 21, the pad one end 23, the pad lower end 22, and the pad other end 24, and is recessed in a shape to correspond with the coupling protrusion 15 from the pad upper end 21, the pad one end 23, the pad lower end 22, and the pad other end 24 such that the coupling protrusion 15 is sat thereon. In other words, the coupling groove 25 is continuously recessed to cross the pad upper end 21, the pad one end 23, the pad lower end 22, and the pad other end 24. Herein, coherence between the pad mounting portion 18 and the pad 20 is increased, and simultaneously, water tightness is reinforced by a step as the coupling protrusion 15 is inserted into the coupling groove 25.

The rib hole 27 is bored into the pad 20 from the coupling groove 25 formed at the pad one end 23 to the coupling groove 25 formed at the pad other end 24. In addition, the rib hole 27 is formed in a shape to correspond with the stiffening rib 17 such that the stiffening rib 17 is sat thereon. Further, coherence between the pad mounting portion 18 and the pad 20 is increased as the stiffening rib 17 is disposed to be inserted into the rib hole 27. The disposal of inserting the stiffening rib 17 into the rib hole 27 is possible by directly injection-molding the pad 20 having the hydrophilic expansion rubber material to the body 10.

Meanwhile, thicknesses of the mounted upper end 11, the mounted lower end 12, the mounted one end 13, and the mounted other end 14 are equal and are thicker than the other part of the pad mounting portion 18 if a direction of representing a distance between both surfaces, which are respectively formed in a curve surface, of the pad mounting portion 18 is to be a reference for deciding a thickness of a structure 1 mounted in a water jacket for a cylinder block according to an exemplary embodiment of the present invention, and a thickness of the pad 20, which is equal to thicknesses of the pad upper end 21, the pad lower end 22, the pad one end 23, and the pad other end 24, is formed to be uniform and to be equal to thicknesses of the mounted upper end 11, the mounted lower end 12, the mounted one end 13, and the mounted other end 14 when the pad 20 is injection-molded. In this regard, it goes without saying that the mounted upper end 11, the mounted lower end 12, and the pad 20 have a curvature to be equal to the pad mounting portion 18.

Figure 6:
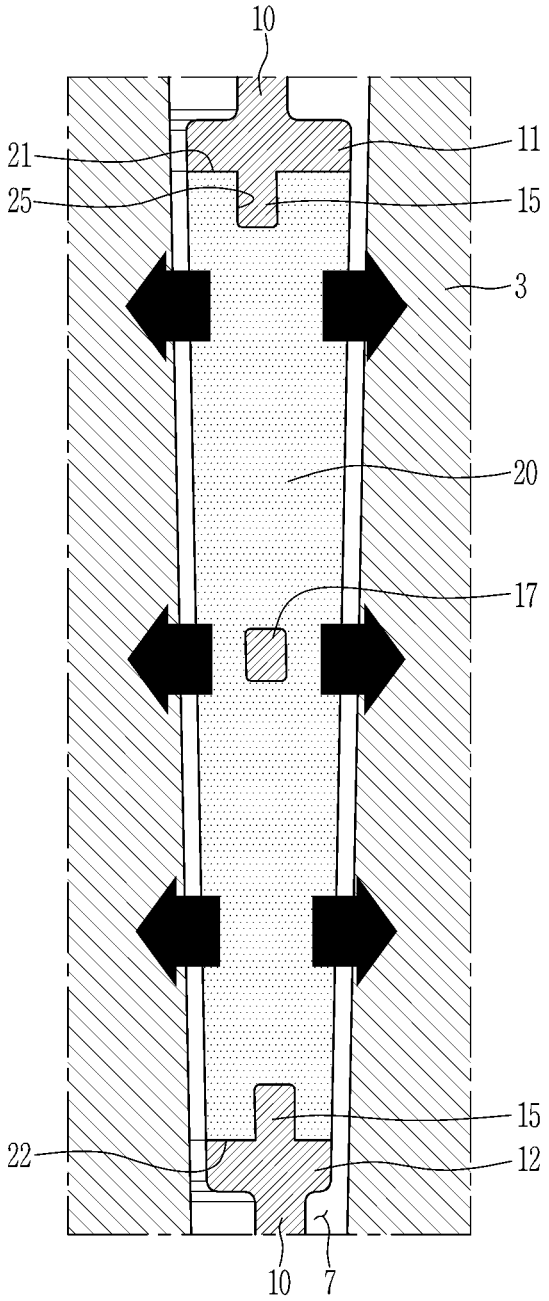
FIG. 6 is a cross-sectional view to illustrate performance of a structure mounted in a water jacket for a cylinder block according to an exemplary embodiment of the present invention.

FIG. 6 is a cross-sectional view to illustrate performance of a structure mounted in a water jacket for a cylinder block according to an exemplary embodiment of the present invention. In addition, FIG. 6 is a drawing for enlarging a part of FIG. 1 and illustrating the enlarged part as a plane.

As shown in FIG. 6, a structure 1 mounted in a water jacket for a cylinder block according to an exemplary embodiment of the present invention is inserted into the water jacket 7 of the cylinder block 3 after being manufactured so that the body 10 and the pad 20 are coupled with each other.

A structure 1 mounted in a water jacket for a cylinder block according to an exemplary embodiment of the present invention acts so that the pad 20 expands by contacting with coolant when coolant is flowed in the water jacket 7 in a state of being inserted into the water jacket 7. At this time, it is limited by respective the mounted upper end 11, the mounted lower end 12, the mounted one end 13, and the mounted other end 14 that the pad upper end 21, the pad lower end 22, the pad one end 23, and the pad other end 24 of the pad 20 are respectively expanded, and thus the pad 20 is expended in a thickness direction so as to contact to the cylinder block 3. When the pad 20 is contacted to the cylinder block 3 like this, area that coolant is contacted with the cylinder block 3 is reduced, thereby realizing warm block for keeping warmth of the cylinder block 3.

In FIG. 6, a direction of expanding the pad 20 is illustrated by arrows. Herein, as the pad 20 formed of the hydrophilic expansion rubber material directly injection-molded to the body 10, an additional component which is mounted to the body 10 in a state of mounting the pad 20 thereto is not required, and further, as components such as a clip or a spring which is formed at or provided to the additional component for assembling and supporting, a substantive thickness of a structure 1 mounted in a water jacket for a cylinder block according to an exemplary embodiment of the present invention can be to be thinner in comparison with an ordinary configuration that the additional component is required thereto. Therefore, inserting a structure 1 mounted in a water jacket for a cylinder block according to an exemplary embodiment of the present invention into the water jacket 7 or escaping the structure 1 from the water jacket 7 by a worker or a manufacturing device may be easy. On the other hand, as the additional component is not required such that area of contacting the pad 20 with the cylinder block 3 may be increased in comparison with an ordinary configuration, it is possible that the pad 20 is manufactured so that a thickness of the pad 20 is to be increased. Therefore, warm block performance can be improved by increasing area of contacting the pad 20 and the cylinder block 3, and as an established gap between the pad 20 and the cylinder block 3 is to be narrow, warm block performance can be ensured by realizing contact of the pad 20 and the cylinder block 3 even though expansion coefficient of the pad 20 is to be small. The configuration that the pad 20 has small expansion coefficient means a configuration that little expansible resin is contained into the pad 20 formed of the hydrophilic expansion rubber material, and the material cost may be reduced as little expansible resin is contained thereinto. Further, as the additional component, which is generally formed of a SUS material, is removed, necessary expenses may be reduced for providing a expensive SUS material component. Herein, the SUS which is one classification of a stainless steel material is well known to a person of an ordinary skill in the art, so a detailed description thereof will be omitted.

According to an exemplary embodiment of the present invention, an additional component for assembling the pad 20 with the body 10 is not required as the pad 20 is directly molded to the body 10 such that a number of components may be reduced and a process may be downsized. In addition, expansion coefficient required to the pad 20 is small such that the material cost may be reduced. Further, area of the cylinder block 3 to which the pad 20 is contacted is increased such that warm block performance may be improved, and simultaneously, entire capacity of coolant accepted into the water jacket 7 for the cylinder block is reduced such that cooling performance may be better by rapid circulation of coolant. Furthermore, as it is possible that the body 10 to which the pad 20 is mounted is manufactured to be thin, assembling the embed structure 1 with the water jacket 7 for the cylinder block or escaping the embed structure 1 from the water jacket 7 for the cylinder block may be to be easy.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A structure to be mounted in a water jacket for a cylinder block of an engine so as to surround a block bore, the structure comprising:

a body forming a pad mounting portion comprising a panel formed in an arc shape to have inner and outer curved surfaces that are surrounded by the block bore, a mounting hole extending through the inner and outer curved surfaces of the pad mounting portion; and a pad formed in a shape to correspond with the mounting hole, the pad having a curved surface and being inserted into the mounting hole in a water tight manner;

wherein the pad mounting portion comprises:

a mounted upper end closing an upper side of the mounting hole;

a mounted lower end disposed to face to the mounted upper end and adapted to close a lower side of the mounting hole;

a mounted one end connecting the mounted upper end with the mounted lower end and closing one side of the mounting hole; and a mounted other end disposed to face to the mounted one end and adapted to connect the mounted upper end with the mounted lower end and close the other side of the mounting hole;

a coupling protrusion protruded along the mounted upper end, the mounted one end, the mounted lower end, and the mounted other end; and a stiffening rib formed in a bar shape to connect the coupling protrusion that is formed at the mounted one end with the coupling protrusion that is formed at the mounted other end so as to partition the mounting hole into two sections; and wherein the pad comprises:

a pad upper end coupled to the mounted upper end in a water tight manner;

a pad lower end coupled to the mounted lower end in a water tight manner;

a pad one end coupled to the mounted one end in a water tight manner; and a pad other end coupled to the mounted other end in a water tight manner;

a coupling groove recessed in a shape to correspond with the coupling protrusion along the pad upper end, the pad one end, the pad lower end, and the pad other end such that the coupling protrusion sits on the coupling groove; and a rib hole bored into the pad from the coupling groove that is formed at the pad one end to the coupling groove that is formed at the pad other end and formed in a shape to correspond with the stiffening rib such that the stiffening rib sits on the rib hole.

2. A structure to be mounted in a water jacket for a cylinder block of an engine so as to surround a block bore, the structure comprising:

a body forming a pad mounting portion comprising a panel formed in an arc shape to have inner and outer curved surfaces that are surrounded by the block bore, a mounting hole extending through the inner and outer curved surfaces of the pad mounting portion, wherein the pad mounting portion comprises a stiffening rib formed in a bar shape to so as to partition the mounting hole into two sections; and a pad formed in a shape to correspond with the mounting hole, the pad having a curved surface and being inserted into the mounting hole in a water tight manner, wherein the pad comprises a rib hole bored into the pad and formed in a shape to correspond with the stiffening rib such that the stiffening rib sits on the rib hole.

3. The structure of claim 2, wherein the body is disposed in an up and down direction of the water jacket.

4. The structure of claim 2, wherein the body is formed of a plastic material.

5. The structure of claim 2, wherein the structure comprises a plurality of pads and the body is formed in a plate shape having a plurality of pad mounting portions, each pad being mounted to a corresponding pad mounting portion.

6. The structure of claim 2, wherein the pad is formed of a hydrophilic expansion rubber material.

7. The structure of claim 2, wherein the pad mounting portion comprises:

a mounted upper end closing an upper side of the mounting hole;

a mounted lower end disposed to face to the mounted upper end and adapted to close a lower side of the mounting hole;

a mounted one end connecting the mounted upper end with the mounted lower end and closing one side of the mounting hole; and a mounted other end disposed to face to the mounted one end and adapted to connect the mounted upper end with the mounted lower end and close the other side of the mounting hole.

8. The structure of claim 7, wherein the pad comprises:

a pad upper end coupled to the mounted upper end in a water tight manner;

a pad lower end coupled to the mounted lower end in a water tight manner;

a pad one end coupled to the mounted one end in a water tight manner; and a pad other end coupled to the mounted other end in a water tight manner.

9. The structure of claim 8, wherein the pad mounting portion further comprises a coupling protrusion protruded along the mounted upper end, the mounted one end, the mounted lower end, and the mounted other end; and wherein the pad further comprises a coupling groove recessed in a shape to correspond with the coupling protrusion along the pad upper end, the pad one end, the pad lower end, and the pad other end such that the coupling protrusion sits on the coupling groove.

10. The structure of claim 9, wherein the coupling protrusion is formed so as to be continuously protruded to cross the mounted upper end, the mounted one end, the mounted lower end, and the mounted other end.

11. The structure of claim 9, wherein the stiffening rib of the pad mounting portion connects the coupling protrusion that is formed at the mounted one end with the coupling protrusion that is formed at the mounted other end so as to partition the mounting hole into the two sections; and wherein the rib hole of the pad is bored into the pad from the coupling groove that is formed at the pad one end to the coupling groove that is formed at the pad other end.

12. The structure of claim 11, wherein the mounting hole is halved by the stiffening rib.

13. The structure of claim 11, wherein the stiffening rib has a curvature that corresponds to the pad mounting portion.

14. The structure of claim 9, wherein the coupling groove is formed to be continuously recessed to cross the pad upper end, the pad one end, the pad lower end, and the pad other end.

15. The structure of claim 8, wherein, when coolant is flowed in the water jacket, the pad contacting the coolant is expanded in a thickness direction so as to contact to the cylinder block in a state that it is limited by respective the mounted upper end, the mounted lower end, the mounted one end, and the mounted other end that the pad upper end, the pad lower end, the pad one end, and the pad other end are respectively expanded.

16. The structure of claim 7, wherein the pad is directly injection-molded to the body.

17. The structure of claim 16, wherein thicknesses of the mounted upper end, the mounted lower end, the mounted one end, and the mounted other end are equal, and a thickness of the pad is formed to be uniform and to be equal to thicknesses of the mounted upper end, the mounted lower end, the mounted one end, and the mounted other end.

18. The structure of claim 17, wherein thicknesses of the mounted upper end, the mounted lower end, the mounted one end, and the mounted other end are thicker than another part of the pad mounting portion.

19. The structure of claim 7, wherein the mounted upper end, the mounted lower end, and the pad have a curvature corresponding to the pad mounting portion.

20. A structure to be mounted in a water jacket for a cylinder block of an engine so as to surround a block bore, the structure comprising:

a body forming a pad mounting portion comprising a panel formed in an arc shape to have inner and outer curved surfaces that are surrounded by the block bore, a mounting hole extending through the inner and outer curved surfaces of the pad mounting portion, wherein the pad mounting portion comprises a coupling protrusion protruded along inner walls of the mounting hole; and a pad formed in a shape to correspond with the mounting hole, the pad having a curved surface and being inserted into the mounting hole in a water tight manner, wherein the pad comprises a coupling groove recessed along outer edges of the pad in a shape to correspond with the coupling protrusion.

* * * * *